US008261525B2

(12) United States Patent
Liu et al.

(10) Patent No.: US 8,261,525 B2
(45) Date of Patent: Sep. 11, 2012

(54) BAST FIBRE YARN, MULTI-FIBRE YARN AND PROCESSES FOR MAKING THE SAME

(75) Inventors: Guozhong Liu, Jiangsu (CN); Zhenhua Zhang, Jiangsu (CN)

(73) Assignee: Jiangsu Redbud Textile Technology Co., Ltd. (CN)

( * ) Notice: Subject to any disclaimer, the term of this patent is extended or adjusted under 35 U.S.C. 154(b) by 37 days.

(21) Appl. No.: 12/733,235

(22) PCT Filed: Aug. 15, 2008

(86) PCT No.: PCT/CN2008/001476

§ 371 (c)(1),
(2), (4) Date: Feb. 18, 2010

(87) PCT Pub. No.: WO2009/024023

PCT Pub. Date: Feb. 26, 2009

(65) Prior Publication Data

US 2010/0139237 A1 Jun. 10, 2010

(30) Foreign Application Priority Data

Aug. 20, 2007 (CN) ..... 2007 1 0143317
Aug. 20, 2007 (CN) ..... 2007 1 0143318

(51) Int. Cl.
*D02G 3/02* (2006.01)

(52) U.S. Cl. ..... 57/252

(58) Field of Classification Search ..... 57/252, 57/256; 162/94, 98
See application file for complete search history.

(56) References Cited

U.S. PATENT DOCUMENTS

| | | | | |
|---|---|---|---|---|
| 2,721,358 | A * | 10/1955 | Jozsef Litvan et al. | 19/7 |
| 5,513,805 | A * | 5/1996 | Fisher et al. | 241/18 |
| 6,330,786 | B1 * | 12/2001 | Settle | 57/200 |
| 2003/0056484 | A1 * | 3/2003 | Oda | 57/28 |
| 2006/0059884 | A1 * | 3/2006 | Zhou et al. | 57/252 |
| 2007/0199669 | A1 * | 8/2007 | Yang et al. | 162/90 |

FOREIGN PATENT DOCUMENTS

RU 2109859 C1 * 4/1998

* cited by examiner

*Primary Examiner* — Shaun R Hurley
(74) *Attorney, Agent, or Firm* — Schwegman Lundberg & Woessner, P.A.

(57) ABSTRACT

The present invention introduces a process of spinning bast fibers through health preserving. Various examples include health preserving bast fibers; opening and cleaning, and carding the health preserved bast fibers, and drawing the carded health preserved bast fibers into bast fiber strips; health preserving said bast fiber strips; and spinning the health preserved fiber strips into yarn. Examples of the present invention also introduce a kind of yarn made by such processes. Examples of the present invention further introduce a process of blended spinning bast fiber with other fibers through health preserving, and the yarn made by such processes. Examples of the present invention realize low end breakage rates, and high efficiency, so as to achieve high quality products.

12 Claims, No Drawings

BAST FIBRE YARN, MULTI-FIBRE YARN AND PROCESSES FOR MAKING THE SAME

RELATED APPLICATIONS

This application is a nationalization under 35 U.S.C. 371 of PCT/CN2008/001476, filed Aug. 15, 2008, and published as WO 2009/024023 A1 on Feb. 26, 2009, which claims priority to Chinese Patent Application Serial No. 200710143318.5, filed Aug. 20, 2007; and Chinese Patent Application Serial No. 200710143317.0, filed Aug. 20, 2007, which applications and publication are incorporated herein by reference in their entirety and made a part hereof.

TECHNICAL FIELD

The present invention relates to a bast fibre yarn obtained through spinning bast fibres, and a process of making thereof, in particular, relates to a bast fibre yarn obtained through twice health-preserving bast fibres and blended spinning bast fibres and other fibres, together with a process of making thereof.

BACKGROUND OF THE INVENTION

Bast fabrics have gained more and more popularity with people, as they are low electrostatic material, and provide antibacterial properties and great absorbency. However, bast fibre, especially jute fibres, include a great amount of lignin, which is more rigid and brittle than cotton fibres. Generally, bast fibres need to be humidified for health preserving before the fibres are spun by existing technology, wherein, health preserving refers to putting bast fibres in a certain temperature and humidity environment for a certain period of time. Health preserving can improve the flexibility of bast fibres. However, because of the loss of water during processing, bast fibres will become dry and easily broken. For instance, in the art of blended spinning bast fibres and other fibres, when the yarn is 12s in thinness, the end breakage rate may reach up to 300-400 times per hour for each machine on average, which greatly raises the difficulty of bast fibres spinning, thereby reducing work efficiency and the quality of products.

BRIEF DESCRIPTION OF INVENTION

One of the purposes of this invention is to provide a bast fibre yarn obtained through spinning bast fibres, and also provide a simple and efficient process of making bast fibre yarn, the bast fibre yarn having a low end breakage rate. Another purpose of this invention is to provide a multi-fibre yarn obtained through blended spinning bast fibres and other fibres, and further to provide a simple and efficient process of making a multi-fibre yarn, the multi-fibre yarn having a low end breakage rate.

In the present invention, a process for spinning bast fibres comprising the steps of:

a. Health preserving bast fibres;
b. Opening, cleaning, and carding the health preserved bast fibres, then, drawing the carded health preserved bast fibres into bast fibre strips;
c. Health preserving said bast fibre strips;
d. Spinning the health preserved bast fibre strips into bast fibre yarn.

The process for spinning bast fibres, wherein the step c is implemented under the circumstance where the temperature falls within a range from 30° C. to 80° C.

The process for spinning bast fibres, wherein said step c is implemented under the circumstance where the relative humidity falls within a range from 80% to 100%.

The process for spinning bast fibres, wherein said step c is implemented under the circumstance where the duration of health preserving said bast fibre strips falls within a range from 2 hours to 14 hours.

The process for spinning bast fibres, wherein said bast fibres are either jute fibres, kenaf fibres, or hemp fibres, or at least two of them.

The process for spinning bast fibres, wherein the weight percentage of jute fibres in the bast fibres falls within a range from 20% to 100%.

A bast fibres yarn, wherein said bast fibre yarn is produced through the following steps:

a. Health preserving bast fibres;
b. Opening, cleaning, and carding the health preserved bast fibres, then drawing the carded health preserved bast fibres into bast fibre strips;
c. Health preserving said bast fibre strips;
d. Spinning the health preserved bast fibre strips into bast fibre yarn.

The bast fibres yarn, wherein said bast fibres are either jute fibres, kenaf fibres, or hemp fibres, or at least two of them.

The bast fibres yarn, wherein the weight percentage of jute fibres in said bast fibres falls within a range from 20% to 100%.

A process for blended spinning bast fibres and other fibres comprises the steps of:

a. Health preserving bast fibres.
b. Blending the health preserved bast fibres with other fibres, then Opening, cleaning, and carding the blended fibres, after that drawing the carded blended fibres into multi-fibre strips.
c. Health preserving said multi-fibre strips;
d. Spinning the health preserved multi-fibre strips into multi-fibre yarn.

The process for blended spinning bast fibres and other fibres, wherein, the temperature for the step c falls within a range from 30° C. to 80° C.

The process for blended spinning bast fibres and other fibres, wherein the relative humidity for said step c falls within a range from 80% to 100%.

The process for blended spinning bast fibres and other fibres, wherein, the duration of step c falls within a range from 2 hours to 14 hours.

The process for blended spinning bast fibres and other fibres, wherein said bast fibres are either jute fibres, kenaf fibres, or hemp fibres, or at least two of them.

The process for blended spinning bast fibres and other fibres, wherein the weight percentage of jute fibres in said bast fibres falls within a range from 20% to 100%.

The process for blended spinning bast fibres and other fibres, wherein the weight percentage of bast fibres in the blended fibres falls within a range from 20% to 99%.

A multi-fibre yarn, wherein said multi-fibre yarn is produced through the following steps:

a. Health preserving bast fibres;
b. Blending the health preserved bast fibres with other fibres, then Opening cleaning, and carding the, blended fibres, after that drawing the carded blended fibres into multi-fibre strips.
c. Health preserving said multi-fibre strips;
d. Spinning the health preserved multi-fibres strips into multi-fibre yarn.

The multi-fibre yarn, wherein, said bast fibres are either jute fibres, kenaf fibres, or hemp fibres, or at least two of them.

The multi-fibre yarn, wherein, the weight percentage of jute fibres in bast fibres falls within a range from 20% to 100%.

Various embodiments of the present invention have one or more of the following advantages compared to the existing technologies. In the present invention, the art of conducting health preserving twice is adopted for blended spinning bast fibres and blended spinning bast fibres and other fibres, which allows the products to have more flexibility, and also improves the spinnability of bast fibres, thereby improving work efficiency and the quality of products. For instance, according to the processes introduced in the present invention, the end breakage rate of yarn will be on average reduced to 150-200 times per hour for each machine when the yarn is 12s in fineness.

DETAILED DESCRIPTION OF THE INVENTION

Various embodiments of the present invention have been chosen for purposes of description, wherein:

Example 1

An experiment is conducted by, firstly, health preserving jute fibres by existing technologies; then Opening, cleaning, and carding the health preserved jute fibres; next, drawing the carded health preserved fibres into jute fibre strips; after that, health preserving the jute fibre strips for 2 hours under the circumstance where the temperature is 30° C., and the relative humidity is 85%; finally, spinning the health preserved jute fibre strips into jute fibre yarn. It is discovered after the experiment on 100 samplings that end breakage rate of jute fibre yarn has been reduced on average to 200 times per hour for each machine when the jute fibre yarn is 12s in fineness.

Example 2

An experiment is conducted by, firstly, health preserving jute fibres by existing technologies; then Opening, cleaning, and carding the health preserved jute fibres; next, drawing the carded health preserved fibres into jute fibre strips; after that, health preserving the jute fibre strips for 14 hours under the circumstance where the temperature is 80° C., and the relative humidity is 90%; finally spinning the health preserved jute fibre strips into jute fibre yarn. It is discovered after the experiment on 100 samplings that end breakage rate of jute fibre yarn has been reduced on average to 161 times per hour for each machine when the jute fibre yarn is 12s in fineness.

Example 3

An experiment is conducted by, firstly, health preserving jute fibres by existing technologies; then Opening, cleaning, and carding the health preserved jute fibres; next, drawing the carded health preserved jute fibres into jute fibre strips; after that, health preserving the jute fibre strips for 4 hours under the circumstance where the temperature is 50° C., and the relative humidity is 100%; finally spinning the health preserved jute fibre strips into jute fibre yarn. It is discovered after the experiment on 100 samplings that end breakage rate of jute fibre yarn has been reduced on average to 176 times per hour for each machine when the jute fibre yarn is 12s in fineness.

Example 4

An experiment is conducted by, firstly, health preserving kenaf fibres by existing technology; then Opening, cleaning, and carding the health preserved kenaf fibres; next, drawing the carded health preserved kenaf fibres into kenaf fibre strips; after that, health preserving the kenaf fibre strips for 3 hours under the circumstance where the temperature is 40° C., and the relative humidity is 95%; finally, spinning the health preserved kenaf fibre strips into kenaf fibre yarn. It is discovered after the experiment on 100 samplings that end breakage rate of kenaf fibre yarn has been reduced to 182 times per hour for each machine on average when the kenaf fibre yarn is 12s in fineness.

Example 5

An experiment is conducted by, firstly, health preserving linen fibres by existing technology; then Opening, cleaning, and carding the health preserved linen fibres; next, drawing the carded health preserved linen fibres into linen fibre strips; after that, health preserving the linen fibre strips for 6 hours under the circumstance where the temperature is 60° C., and the relative humidity is 85%; finally, spinning the health preserved linen fibre strips into linen fibre yarn. It is discovered after the experiment on 100 samplings that end breakage rate of linen fibre yarn has been reduced to 154 times per hour for each machine on average when the linen fibre yarn is 12s in fineness.

Example 6

An experiment is conducted by, firstly, health preserving hemp fibres by existing technology; then Opening, cleaning, and carding the health preserved hemp fibres; next, drawing the carded health preserved hemp fibres into hemp fibre strips; after that, health preserving the hemp fibre strips for 10 hours under the circumstance where the temperature is 70° C., and the relative humidity is 80%; finally spinning the health preserved hemp fibre strips into hemp fibre yarn. It is discovered after the experiment on 100 samplings that end breakage rate of hemp fibre yarn has been reduced to 168 times per hour for each machine on average when the hemp fibre yarn is 12s in fineness.

Example 7

An experiment is conducted by, firstly, health preserving bast fibres by existing technology, wherein said bast fibres comprise 90% jute fibres and 10% kenaf fibres in weight percentage; then Opening, cleaning, and carding the health preserved combination of jute fibres and kenaf fibres; next, drawing the carded bast fibre combination into bast fibre strips; after that, health preserving the bast fibre strips for 8 hours under the circumstance where the temperature is 60° C., and the relative humidity is 95%; finally, spinning the health preserved bast fibre strips into bast fibre yarn. It is discovered after the experiment on 100 samplings that end breakage rate of bast fibre yarn has been reduced to 151 times per hour for each machine on average when the bast fibre yarn is 12s in fineness.

Example 8

An experiment is conducted by, firstly, health preserving bast fibres by existing technology, wherein said bast fibres comprise 20% jute fibres and 80% hemp fibres in weight percentage; then Opening, cleaning, and carding the health preserved bast fibres; next, drawing the carded health preserved bast fibre combination into bast fibre strips; after that, health preserving the bast fibre strips for 12 hours under the circumstance where the temperature is 70° C., and the humidity is 90%; finally, spinning the health preserved bast fibre strips into bast fibre yarn. It is discovered after the experiment on 100 samplings that end breakage rate of bast fibre yarn has been reduced to 150 times per hour for each machine on average when the bast fibre yarn is 12s in fineness.

Example 9

An experiment is conducted by, firstly, health preserving jute fibres by existing technology and blending the health preserved jute fibres with cotton fibres into blended fibres, wherein the weight proportion of jute fibres and cotton fibres is 1:1; then Opening, cleaning, and carding the blended fibres; next, drawing the carded blended fibres into multi-fibre strips; after that, health preserving the multi-fibre strips for 8 hours under the circumstance where the temperature is 70° C., and the relative humidity is 100%; finally, spinning the health preserved multi-fibre strips into multi-fibre yarn. It is discovered after the experiment on 100 samplings that end breakage rate of multi-fibre yarn has been reduced to 150 times per hour for each machine on average when the multi-fibre yarn is 12s in fineness.

Example 10

An experiment is conducted by, firstly, health preserving jute fibres by existing technology and blending the health preserved jute fibres with terylene fibres into blended fibres, wherein the weight proportion of jute fibres and terylene fibres is 99:1; then Opening, cleaning, and carding the blended fibres; next, drawing the carded blended fibres into multi-fibre strips; after that, health preserving the multi-fibre strips for 2 hours under the circumstance where the temperature is 80° C., and the humidity is 80%; finally, spinning the health preserved multi-fibre strips into multi-fibre yarn. It is discovered after the experiment on 100 samplings that end breakage rate of multi-fibre yarn has been reduced to 185 times per hour for each machine on average when the multi-fibre yarn is 12s in fineness.

Example 11

An experiment is conducted by, firstly, health preserving jute fibres by existing technology and blending the health preserved jute fibres with polypropylene fibres into blended fibres, wherein the weight proportion of jute fibres and polypropylene fibres is 55:45; then Opening, cleaning, and carding the blended fibres; next, drawing carded blended fibres into multi-fibre strips; after that, health preserving the blended fibre strips for 14 hours under the circumstance where the temperature is 50° C., and the relative humidity is 90%; finally, spinning the health preserved multi-fibre strips into multi-fibre yarn. It is discovered after the experiment on 100 samplings that the end breakage rate of multi-fibre yarn has been reduced to 163 times per hour for each machine on average when the multi-fibre yarn is 12s in fineness.

Example 12

An experiment is conducted by, firstly, health preserving kenaf fibres by existing technology and blending the health preserved kenaf fibres with cotton fibres into blended fibres, wherein, the weight proportion of kenaf fibres and cotton fibres is 7:3; then, Opening, cleaning, and carding the combination of jute and kenaf; after that, drawing the carded blended fibres into multi-fibre strips; after that, health preserving the blended fibre strips for 4 hours under the circumstance where the temperature is 60° C., and the relative humidity is 85%; finally, spinning the health preserved multi-fibre strips into multi-fibre yarn. It is discovered after the experiment on 100 samplings that end breakage rate of multi-fibre yarn has been reduced to 171 times per hour for each machine on average when the multi-fibre yarn is 12s in fineness.

Example 13

An experiment is conducted by, firstly, health preserving ramee fibres by existing technology and blending the health preserved ramee fibres with cotton fibres into blended fibres, wherein, the weight proportion of ramee fibres and cotton fibres is 1:4; then, Opening, cleaning, and carding the blended fibres; next, drawing the carded blended fibres into multi-fibre strips; after that, health preserving the multi-fibre strips for 4 hours under the circumstance where the temperature is 40° C., and the relative humidity is 95%; finally, spinning the health preserved multi-fibre strips into multi-fibre yarn. It is discovered after the experiment on 100 samplings that end breakage rate of multi-fibre yarn has been reduced to 180 times per hour for each machine on average when the multi-fibre yarn is 12s in fineness.

Example 14

An experiment is conducted by, firstly, health preserving hemp fibres by existing technology and blending the health preserved hemp fibres with cotton fibres into blended fibres, wherein, the weight proportion of hemp fibres and cotton fibres is 2:3; then, Opening, cleaning, and carding the blended fibres; next, drawing the carded blended fibres into multi-fibre strips; after that, health preserving said multi-fibre strips for 3 hours under the circumstance where the temperature is 30° C., and the relative humidity is 85%; finally, spinning the health preserved multi-fibre strips into multi-fibre yarn. It is discovered after the experiment on 100 samplings that end breakage rate has been reduced to 180 times per hour for each machine on average when the multi-fibre yarn is 12s in fineness.

Example 15

An experiment is conducted by, firstly, health preserving bast fibres by existing technology; wherein said bast fibres comprise 20% jute fibres and 80% kenaf fibres in weight percentage; then, blending the health preserved bast fibre combination with cotton fibres into blended fibres; wherein the weight proportion of the bast fibres and cotton fibres is 4:1; next, Opening, cleaning, and carding the blended fibres; after that, drawing the carded blended fibres into multi-fibre strips, and health preserving said multi-fibre strips for 12 hours under the circumstance where the temperature is 70° C., and the relative humidity is 95%; finally, spinning the health preserved multi-fibre strips into multi-fibre yarn. It is discovered after the experiment on 100 samplings that end breakage rate has been reduced to 180 times per hour for each machine on average when the multi-fibre yarn is 12s in fineness.

Example 16

An experiment is conducted by, firstly, health preserving bast fibres by existing technology; wherein said bast fibres comprise 90% jute fibres and 10% hemp fibres in weight percentage; then, blending the health preserved bast fibre combination with cotton fibres into blended fibres; wherein, the weight proportion of the bast fibre combination and cotton fibres is 3:1; next, Opening, cleaning, and carding the blended fibres; after that, drawing carded blended fibres into multi-fibre strips and health preserving said multi-fibre strips for 5 hours under the circumstance where the temperature is 50° C., and the relative humidity is 85%; finally, spinning the health preserved multi-fibre strips into multi-fibre yarn. It is discovered after the experiment on 100 samplings that end breakage rate has been reduced to 162 times per hour for each machine on average when the multi-fibre yarn is 12s in fineness.

While this invention has been described as having several preferred embodiments, the present invention can be further modified within the spirit and scope of this disclosure. This application is therefore intended to cover any variations, uses, or adaptations of the invention using its general principles. Further, this application is intended to cover such departures from this present disclosure as come within known or customary practice in the art to which this invention pertains and which fall within the limits of the appended claims.

What is claimed is:

1. A process for spinning bast fibres comprising:

opening, cleaning, and carding health preserved bast fibres wherein the bast fibres comprise one or more of jute fibres, kenaf fibres, hemp fibres;

drawing the carded health preserved bast fibres into bast fibre strips;

subjecting the bast fibre strips to an environment wherein the temperature is 30 degrees Centigrade to 80 degrees Centigrade and the relative humidity is 80% to 100% for 2 to 14 hours; and spinning the bast fibre strips into bast fibre yarn.

2. The process for spinning bast fibres according to claim 1, wherein the weight percentage of jute fibres in the bast fibres falls within a range from 20% to 100%.

3. A method for making bast fibres yarn, comprising:

opening, cleaning, and carding health preserved bast fibres, and then, drawing the carded health preserved bast fibres into bast fibre strips;

treating said bast fibre strips to an environment wherein the temperature is 30 degrees Centigrade to 80 degrees Centigrade and the relative humidity is 80% to 100% for 2 to 14 hours; and spinning the health preserved bast fibre strips into bast fibre yarn.

4. The bast fibres yarn according to claim 3, wherein said bast fibres are either jute fibres, kenaf fibres, or hemp fibres, or at least two of them.

5. The bast fibres yarn according to claim 4, wherein the weight percentage of jute fibres in bast fibres falls within a range from 20% to 100%.

6. A process for blended spinning bast fibres and other fibres comprising the steps of:

blending health preserved bast fibres with other fibres, then opening, cleaning, and carding the blended fibres, after that drawing the carded blended fibres into multi-fibre strips;

treating said multi-fibre strips to an environment wherein the temperature is 30 degrees Centigrade to 80 degrees Centigrade and the relative humidity is 80% to 100% for 2 to 14 hours; and spinning the health preserved multi-fibre strips into multi-fibre yarn.

7. The process for blended spinning bast fibres and other fibres according to claim 6, wherein said bast fibres are either jute fibres, kenaf fibres, or hemp fibres, or at least two of them.

8. The process for blended spinning bast fibres and other fibres according to claim 7, wherein the weight percentage of jute fibres in said bast fibres falls within a range from 20% to 100%.

9. The process for blended spinning bast fibres and other fibres according to claim 6, wherein the weight percentage of bast fibres in said blended fibres falls within a range from 20% to 99%.

10. A multi-fibre yarn wherein said multi-fibre yarn is produced through the following steps comprising:

blending health preserved bast fibres with other fibres, then opening, cleaning, and carding the blended fibres, after that drawing the carded blended fibres into multi-fibre strips;

treating said multi-fibre strips to an environment wherein the temperature is 30 degrees Centigrade to 80 degrees Centigrade and the relative humidity is 80% to 100% for 2 to 14 hours; and spinning the health preserved multi-fibres strips into multi-fibre yarn.

11. The multi-fibre yarn according to claim 10, wherein said bast fibres are either jute fibres, kenaf fibres, or hemp fibres, or at least two of them.

12. The multi-fibre yarn according to claim 11, wherein the weight percentage of jute fibres in said bast fibres falls within a range from 20% to 100%.

* * * * *